United States Patent [19]

Hardy

[11] Patent Number: 4,878,335

[45] Date of Patent: Nov. 7, 1989

[54] METHODS AND APPARATUS FOR INSERTING OBJECTS WITHIN BALLOONS

[76] Inventor: Donald J. Hardy, 6806 Chateaux, Coeur d'Alene, Id. 83814

[21] Appl. No.: 238,842

[22] Filed: Aug. 31, 1988

[51] Int. Cl.[4] ..... B65B 43/36; B65B 39/02; B65B 39/06; B65B 31/00

[52] U.S. Cl. ..... 53/434; 53/450; 53/570; 53/255; 53/385; 53/390; 137/223; 446/220

[58] Field of Search ..... 53/457, 459, 564, 570, 53/385, 390, 258, 260, 433, 434, 473; 137/1, 223, 584; 446/220, 222, 223, 226

[56] References Cited

U.S. PATENT DOCUMENTS

| | | | |
|---|---|---|---|
| 1,283,095 | 10/1918 | Cummiskey . | |
| 1,745,576 | 2/1930 | Kempien . | |
| 2,351,762 | 6/1944 | Hoover . | |
| 2,383,390 | 8/1945 | Jacobs . | |
| 2,463,517 | 3/1949 | Chromak . | |
| 2,912,791 | 11/1959 | Cohen . | |
| 3,298,156 | 1/1967 | Lerner | 53/459 |
| 3,350,838 | 11/1967 | Rodrigues . | |
| 3,559,370 | 2/1971 | Byington et al. | 53/385 |
| 3,925,967 | 12/1975 | Bloemhof | 53/385 |
| 3,958,393 | 5/1976 | Whitener . | |
| 4,213,267 | 7/1980 | Curtis . | |
| 4,262,091 | 4/1981 | Cox | 53/434 X |
| 4,300,767 | 11/1981 | Reed et al. . | |
| 4,569,337 | 0/1986 | Ellis . | |
| 4,704,934 | 11/1987 | Nosrati . | |
| 4,809,483 | 3/1989 | Lovik | 53/385 X |
| 4,809,484 | 3/1989 | Lovik | 53/570 X |

FOREIGN PATENT DOCUMENTS

| | | |
|---|---|---|
| 796826 | 4/1936 | France . |
| 460353 | 11/1950 | Italy . |
| 182614 | 2/1963 | Sweden . |
| 893680 | 4/1962 | United Kingdom . |

*Primary Examiner*—Horace M. Culver
*Attorney, Agent, or Firm*—Thorpe, North & Western

[57] ABSTRACT

An apparatus and methods are provided for placing objects inside inflated balloons. The apparatus includes a walled enclosure having a balloon nozzle opening of a predetermined size and shape about which a balloon mouth within a predetermined size range is sealingly receivable. The enclosure also includes an access opening through which a user's arm is sealing receivable. A port is also provided for supplying an inflation gas into the enclosure. In operation, the object to be placed within the balloon is placed within the enclosure and a balloon mouth is stretched about the balloon opening. A user's arm is inserted through the access opening to grasp the object and move the object through the balloon opening and into the inflated balloon.

27 Claims, 4 Drawing Sheets

METHODS AND APPARATUS FOR INSERTING OBJECTS WITHIN BALLOONS

TECHNICAL FIELD

This invention relates to balloons, and the methods and apparatus for placing objects inside balloons.

BACKGROUND OF THE INVENTION

Many patents evidence that objects have been inserted inside of balloons. For example, U.S. Pat. No. 1,283,095 to Cummiskey discloses inserting three metal balls into a balloon and subsequently inflating the balloon. U.S. Pat. No. 1,745,576 to Kempien closes a toy balloon tied to a stick having one or more metal balls received therein. U.S. Pat. No. 2,383,390 to Jacobs discloses a balloon having an illuminated American flag received therein. U.S. Pat. No. 2,463,517 to Chromak discloses a balloon having a reflector received therein. British Pat. No. 893,680 to Kroto discloses a balloon having a second balloon received therein. U.S. Pat. No. 4,704,934 to Nosrati discloses a balloon having a music device received therein.

This invention is directed to improving methods by which objects are placed in balloons and to provide an apparatus therefor.

BRIEF DESCRIPTION OF THE DRAWINGS

Preferred embodiments of the invention are illustrated in the accompanying drawings, in which.

DETAILED DESCRIPTION OF PREFERRED EMBODIMENTS

Figure 1:
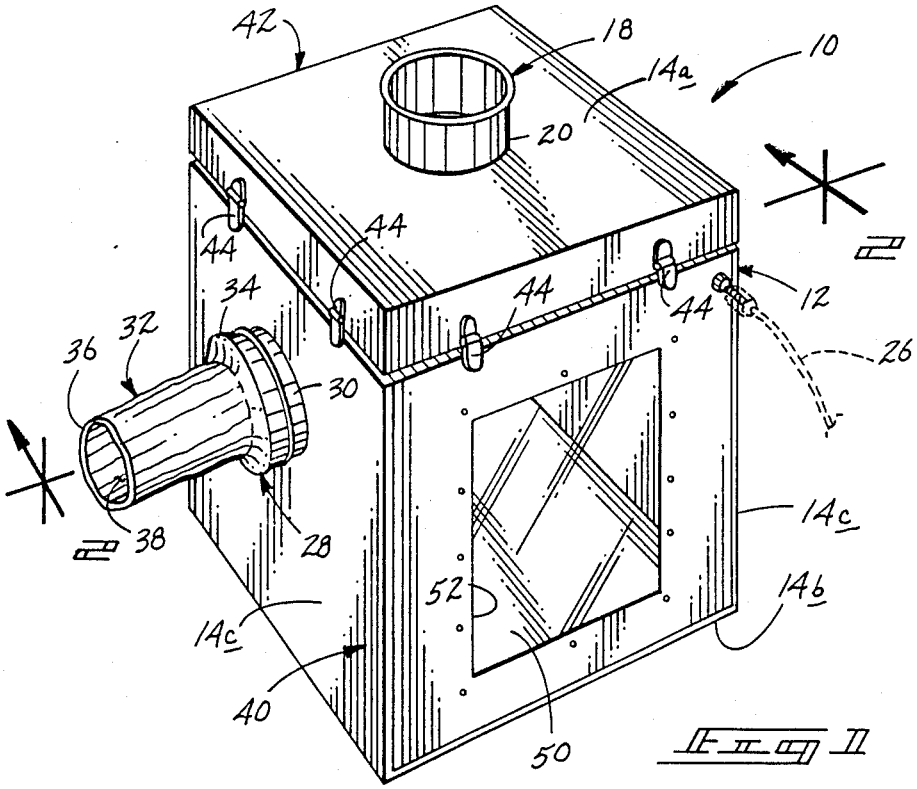
FIG. 1 is a perspective view of an apparatus in accordance with the invention.
Figure 2:
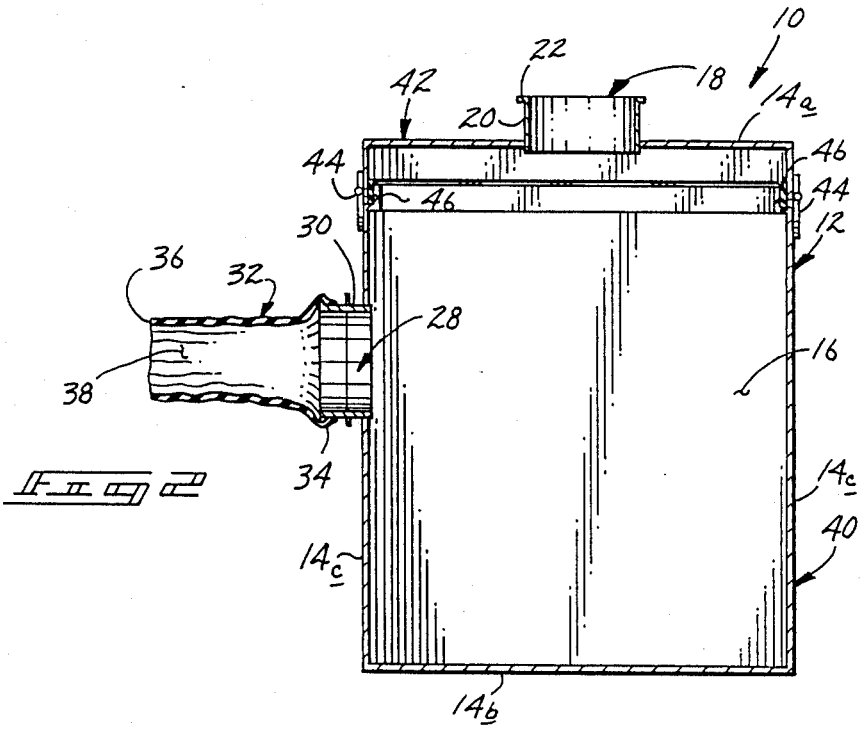
FIG. 2 is a cross-sectional view taken along line 2—2 in FIG. 1.

The following disclosure of the invention is submitted in compliance with the constitutional purpose of the Patent Laws "to promote the progress of science and useful arts" (Article 1, Section 8).

Referring to FIGS. 1–4, an apparatus for use in producing an inflated balloon having an object contained therein is indicated generally by reference numeral 10. Apparatus 10 is comprised of an enclosure 12 defined by sealingly interconnected aluminum walls 14*a,b,c* which in operation are positionally fixed relative to one another. As illustrated, walls 14 define a cubicle or box like construction. Walls 14*a* and 14*b* define top and bottom walls respectively, while walls 14*c* define side walls. Many alternate enclosure shapes, such as spherical or an elongated cylinder, could also be employed without departing from the principles and scope of the invention. For purposes of this document, the term "walls" defines any structural components which define an internal enclosure volume 16, whether comprised of interconnected panel like walls 14*a,b,c* as illustrated, or a single continuous wall of, for example, a spherical construction. Internal volume 16 defined by walls 14*a,b,c* is sufficiently large to retain any predetermined maximum size object to be placed within a predetermined size balloon. The object to be inserted into the balloon will typically be larger than the internal volume of an uninflated balloon.

Enclosure 12 includes a balloon nozzle opening 18 of predetermined size and shape formed in top wall 14*a*. As illustrated, balloon opening 18 is circular in lateral cross-section including exposed walls 20 which project upwardly from top wall 14*a*. Walls 20 form a nozzle like opening and are adapted for sealingly receiving a balloon mouth 17 of a balloon 15 thereabout. The size and shape of balloon opening 18 is configured to received balloon mouths that are stretchable up to some predetermined maximum expandable size. The object to be inserted within the balloon also must be of a size that will pass through opening 18 between walls 20. The upper or outermost end of walls 20 includes an outwardly flared portion 22 to assist in retaining the balloon mouth about such walls as the ballon is inflated. (See, for example, FIG. 4.)

A male threaded injection port 24 is received adjacent the top of front facing side wall 14*c* and is adapted for connection with an air or other inflation gas supply hose 26. Injection port 24 functions as an injection means for enabling filling and pressurizing of enclosure 12 with an inflation gas to inflate the balloon about balloon opening 18.

Enclosure 12 includes an access opening 28 which is separate and spaced from balloon opening 18. Access opening 28 is formed in one of side walls 14*c* and is defined by outwardly projecting cylindrical walls 30. The size of opening 28 defined by walls 30 is of sufficient size to receive a users hand and arm 19 therethrough, as illustrated by FIGS. 3 and 4.

Access opening 28 includes access sealing means which extends therefrom for, (a) fluid sealing enclosure 12 about access opening 28 when a balloon is received about balloon opening 18 and enclosure 12 filled with an inflation gas and sufficiently pressurized to inflate balloon 15, and (b) enabling extension of a user's arm and hand 19 through access opening 28 and into the pressurized enclosure 12 while maintaining inflation of balloon 15. This enables a user to handle the object to be placed in the balloon which is received within the enclosure and pass such object between the balloon opening walls and into the inflated balloon, as illustrated in FIGS. 3 and 4.

In the illustrated and preferred embodiment, the access sealing means comprises a flexible and expandable rubber sleeve 32 having first and second ends 34, 36 respectively. First end 34 is sealingly secured to the exterior surface of walls 30 and thereby sealingly surrounds access opening 28. First end 34 of sleeve 32 is sealed to walls 30 in any suitable manner, such as with adhesive, tape, or merely constriction of the expandable material against walls 30. The seal must be sufficiently strong to hold against pressure exerted by a gas within enclosure 12 sufficient to inflate a balloon about balloon opening 18. Second end 36 of sleeve 32 is open, thereby defining a sleeve opening 38. Opening 38 is sufficiently large for a user's hand and arm to be inserted therethrough.

Figure 3:
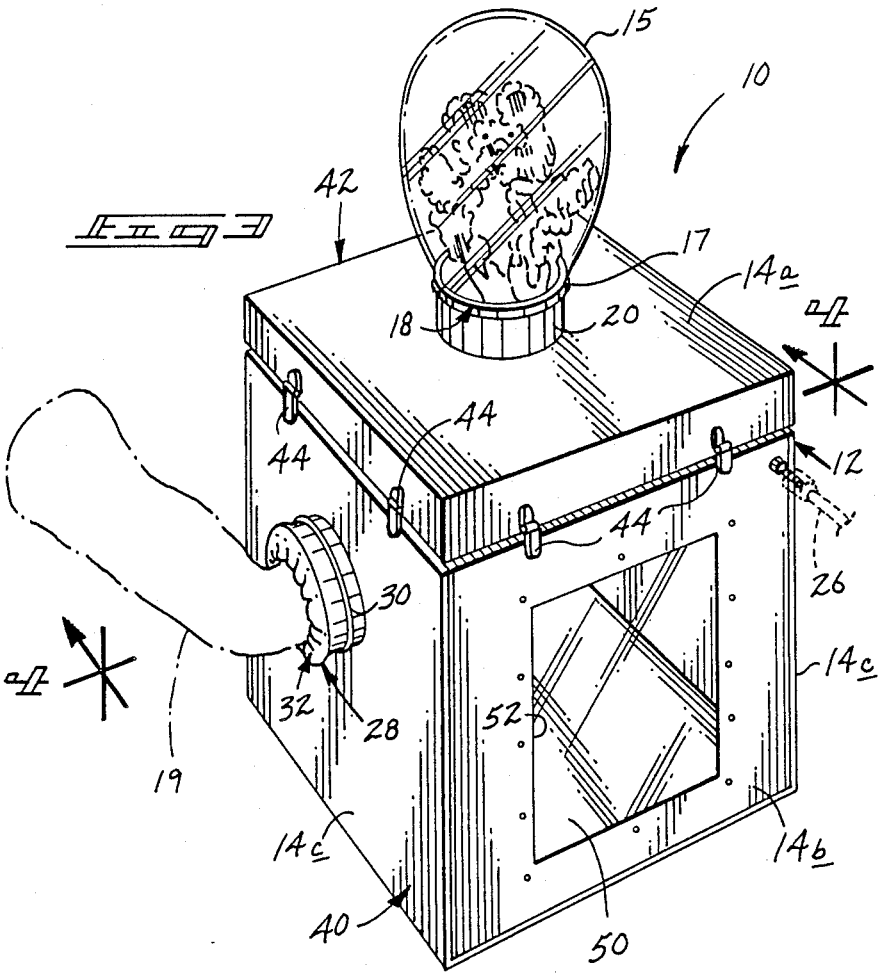
FIG. 3 is a perspective view of the apparatus of FIG. 1 shown being used to inflate and insert an object inside of a balloon.
Figure 4:
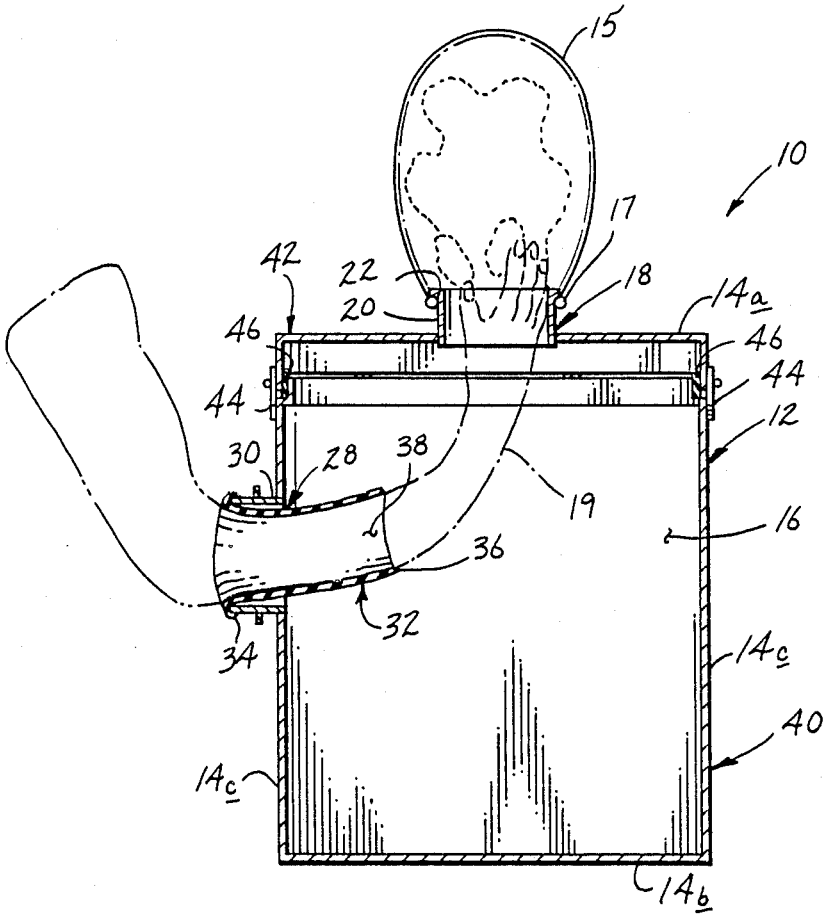
FIG. 4 is a cross-sectional view taken along line 4—4 in FIG. 3.

As illustrated by FIGS. 3 and 4, a user slides his/her hand and arm 19 through sleeve opening 38 and access opening 28 into enclosure 12. This causes sleeve 32 to invert and bear against user's arm 19. Sleeve 32 functions as a seal against the user's arm 19, as illustrated, when enclosure 12 is pressurized with an inflation gas sufficient to inflate balloon 15. This creates a fluid tight seal between the user's arm 19 and sleeve 32. This provides the dual function of enabling access to the enclosure by a user, and at the same time sealing opening 28 relative to internal enclosure volume 16.

Alternate sealing means could also be constructed without departing from the principles and scope of the invention. For example, an invertible flexible sleeve, being sealed at its outer end, could be provided about access opening 28. With this construction, opening 28 would be sealed relative to enclosure 16 regardless of receipt of the sleeve by a user's arm. For example, a user's arm would be inserted into the sleeve, and the sleeve inverted into the enclosure to its full extent. The user could then access the object inside the container with the sealed sleeve end acting as a barrier between the internal and external portions of the enclosure.

Also contemplated by the invention is an enclosure void of any access opening which might still enable the user to manipulate the object inside the enclosure. With such a construction, the user would position the apparatus such that the balloon opening was at the bottom of the container. The object would then be manipulated by tilting the enclosure as necessary to cause it to fall into the inflated balloon through the balloon opening by gravity. Alternately, mechanical or electromechanical arms within the enclosure could be provided for passing the object from the enclosure, through the opening, and into the inflated balloon.

Figure 5:
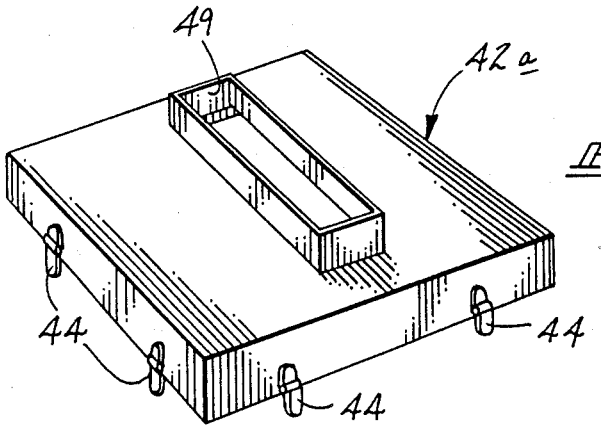
FIG. 5 is a perspective view of an alternate component of the apparatus of FIG. 1.

As illustrated, enclosure 12 is preferably constructed to be of two primary parts comprising a main body section 40 and a first removable top section 42 from which walls 20 of opening 18 project. Removable section 42 is sealingly secured to main body section 40 by a plurality of clamps 44. A sealing gasket 46 is positioned between main section 40 and removable top 42 to achieve the desired fluid tight seal. It is envisioned that such an apparatus could be supplied with multiple alternate replacement removable sections, with one such example **42*a* being illustrated in FIG. 5. The alternate removable sections would be basically the same as that shown in FIGS. 1–4, except having a different sized or shaped balloon opening 49 formed therein. This would enable alternate sized balloons to be used, and differently sized or shaped objects to be placed within balloons. The illustrated alternate end section 42*a* is shown as having an elongated rectangular opening 49** which would enable, for example, a tray to be inserted into a balloon inflated thereabout.

Enclosure 12 is also preferably constructed to include a transparent portion to enable a user to see inside the enclosure when it is pressurized with an inflation gas. As illustrated, the transparent portion of apparatus 10 is in the form of a transparent glass or plastic window 50 sealingly received about a rectangular opening 52 formed in one of enclosure side walls **14*c***.

Figure 6:
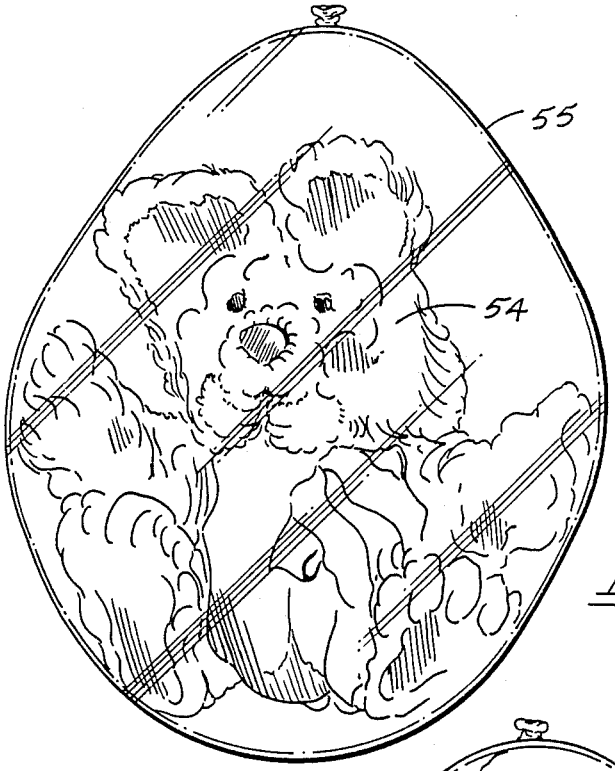
FIG. 6 is a side elevational view of a sealed balloon with an object received therein produced using the apparatus of FIG. 1.

The apparatus in accordance with the invention enables placing of just about any object into an inflated balloon which is stretchable about the enclosure balloon opening 18. FIG. 6 illustrates a stuffed animal 54 being received in an inflated and sealed balloon 55. The stuffed animal would be compressed or otherwise forced through opening 18 and positioned inside of the inflated balloon as desired. The user could then carefully remove the balloon from opening 18 in its inflated state and substantially simultaneously seal the balloon mouth to prevent significant escape of the inflation gas from the balloon. Alternately, the balloon might be inwardly stretchable above its mouth to be sealable prior to removal from the enclosure balloon opening.

Figure 7:
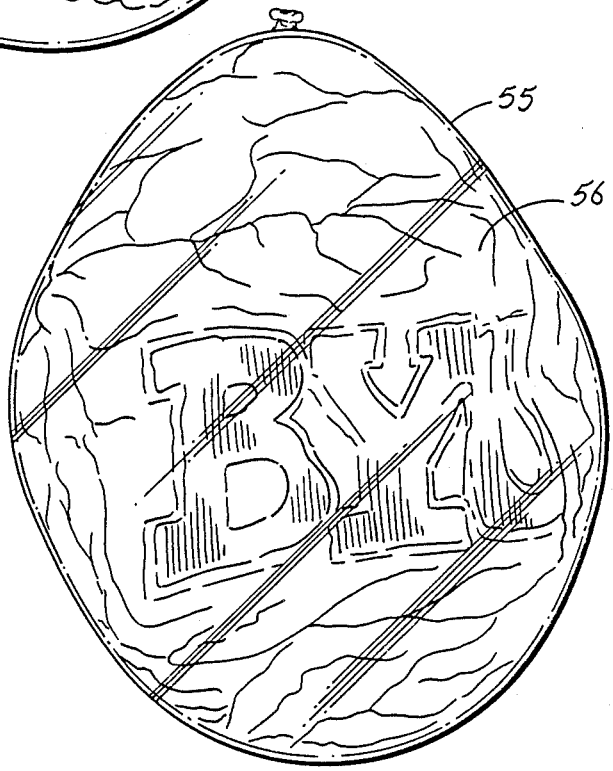
FIG. 7 is a side elevational view of a sealed balloon with an alternate object received therein.

FIG. 7 illustrates a sweatshirt 56 being folded and received within a sealed balloon 55. The sweatshirt 56 would be compressed through opening 18 and positioned within inflated balloon 15. The balloon mouth would then be removed from opening 18, and the balloon allowed to contract about the sweatshirt and be subsequently tied off at its mouth.

Further, a flower arrangement could be provided inside an inflated balloon. A user would provide all the necessary components of the arrangement inside the enclosure and subsequently inflate the balloon about the balloon opening. The user could then construct the arrangement inside of the inflated balloon by accessing the inflated balloon internal volume through the balloon opening 18.

Additonally, as inflated balloon could also include water therein to appropriately display a small boat or other object, including live fish. For example, a sealed water port could be provided in the side of the enclosure for injecting water into the enclosure after the balloon is inflated, with the water gravity flowing into the inflated balloon. Use of the apparatus and methods of the invention would only be limited by the user's imagination.

In compliance with the statute, the invention has been described in language more or less specific as to structural and methodical features. It is to be understood, however, that the invention is not limited to the specific features shown and described, since the disclosed means and construction comprise preferred forms of putting the invention into effect. The invention, is, therefore, claimed in any of its forms or modifications within the proper scope of the appended claims, appropriately interpreted in accordance with the doctrine of equivalents.

I claim:

1. An apparatus for use in producing an inflated balloon having an object contained therein, the balloon having an expandable balloon mouth through which an inflated gas is injectable and the object is insertable, the apparatus comprising:

an enclosure defining an internal volume sufficiently large to receive a predetermined size object to be placed within a predetermined size balloon;

the enclosure including a balloon nozzle opening for sealingly receiving the balloon mouth, the nozzle opening having a size and shape sufficient to enable the object to pass from the enclosure through the nozzle opening and into the balloon;

injection means for filling and pressurizing the enclosure with an inflation gas to inflate the balloon about the balloon opening;

the enclosure including an access opening separate and spaced from the balloon opening, the access opening being sized for receiving a user's hand and arm therethrough; and the access opening including access sealing means extending therefrom for, (a) fluid sealing the enclosure about the access opening when a balloon is received about the balloon opening and the enclosure filled with an inflation gas and sufficiently pressurized to inflate the balloon, and (b) enabling extension of a user's arm and hand through the access opening into the pressurized enclosure while maintaining inflation of the balloon, such that the user can handle the object to be placed in the balloon which is received within the enclosure and pass such object between the balloon opening walls and into the inflated balloon.

2. The apparatus of claim 1 wherein the projecting and exposed walls of the balloon opening have outwardly flared outer ends to assist in retaining the balloon mouth about such walls as the balloon is inflated.

3. The apparatus of claim 1 wherein the walled enclosure includes a transparent portion to enable a user to see inside the enclosure when it is pressurized with an inflation gas.

4. The apparatus of claim 1 wherein, the projecting and exposed walls of the balloon opening have outwardly flared outer ends to assist in retaining the balloon mouth about such walls as the balloon is inflated; and the walled enclosure includes a transparent portion to enable a user to see inside the enclosure when it is pressurized with an inflation gas.

5. The apparatus of claim 1 wherein, the walled enclosure includes a main body section and a first removable section, the balloon opening being formed in the first removable section with the projecting and exposed walls extending therefrom;

releasable clamping means for sealingly securing the first removable section to the main body section; and the apparatus further comprising at least one separate, alternate replacement removable section the same as the first except in having a different size or shape balloon opening formed therein to enable alternate sized balloons to be used, and differently sized or shaped objects to be placed in balloons.

6. The apparatus of claim 5 wherein, the projecting and exposed walls of the balloon opening of each removable section having outwardly flared outer ends to assist in retaining the balloon mouth about such walls as the balloon is inflated; and the walled enclosure includes a transparent portion to enable a user to see inside the enclosure when it is pressurized with an inflation gas.

7. The apparatus of claim 1 wherein the access sealing means comprises a flexible and expandable sleeve having first and second ends, the first end surrounding the access opening, the second end having a sleeve opening, the sleeve opening being sized to receive a user's hand and arm slidably therethrough, the sleeve functioning by being forced against the user's arm when it is inserted through the sleeve opening and the enclosure pressurized within an inflation gas to create a fluid tight seal between the user's arm and sleeve.

8. The apparatus of claim 7 wherein, the projecting and exposed walls of the balloon opening have outwardly flared outer ends to assist in retaining the balloon mouth about such walls as the balloon is inflated; and the walled enclosure includes a transparent portion to enable a user to see inside the enclosure when it is pressurized with an inflation gas.

9. The apparatus of claim 7 wherein, the walled enclosure includes a main body section and a first removable section, the balloon opening being formed in the first removable section with the projecting and exposed walls extending therefrom;

releasable clamping means for sealingly securing the first removable section to the main body section; and the apparatus further comprising at least one separate, alternate replacement removable section the same as the first except in having a different size or shape balloon opening formed therein to enable alternate sized balloons to be used, and differently sized or shaped objects to be placed in balloons.

10. The apparatus of claim 7 wherein the walled enclosure includes a transparent portion to enable a user to see inside the enclosure when it is pressurized with an inflation gas.

11. The apparatus of claim 9 wherein the projecting and exposed walls of the balloon opening of each removable section have outwardly flared outer ends to assist in retaining the balloon mouth about such walls as the balloon is inflated.

12. The apparatus of claim 10 wherein the projecting and exposed walls of the balloon opening of each removable section have outwardly flared outer ends to assist in retaining the balloon mouth about such walls as the balloon is inflated.

13. An inflated balloon having an object therein produced using the apparatus of claim 1.

14. An apparatus for use in producing an inflated balloon having an object contained therein, the balloon having an expandable balloon mouth through which an inflation gas is injectable and the object insertable, the apparatus comprising:

an enclosure having sealingly interconnected walls which are positionally fixed relative to one another, the walls of the enclosure defining a fixed internal enclosure volume sufficiently large to retain a predetermined size object to be placed within a predetermined size balloon;

one of the walls of the enclosure including a balloon opening of a predetermined size and shape, the balloon opening including projecting and exposed walls over and about which a balloon mouth within a predetermined size range is sealingly receivable and between which the object to be placed in the balloon is passable; and injection means for filling and pressurizing the enclosure with an inflation gas to inflate the balloon about the balloon opening.

15. The apparatus of claim 14 wherein the projecting and exposed walls of the balloon opening have outwardly flared outer ends to assist in retaining the balloon mouth about such walls as the balloon is inflated.

16. The apparatus of claim 14 wherein the walled enclosure includes a transparent portion to enable a user to see inside the enclosure when it is pressurized with an inflation gas.

17. The apparatus of claim 14 wherein, the projecting and exposed walls of the balloon opening have outwardly flared outer ends to assist in retaining the balloon mouth about such walls as the balloon is inflated; and the walled enclosure includes a transparent portion to enable a user to see inside the enclosure when it is pressurized with an inflation gas.

18. The apparatus of claim 14 wherein, the enclosure includes a main body section and a first removable section, the balloon opening being formed in the first removable section with the projecting and exposed walls extending therefrom;

releasable clamping means for sealingly securing the first removable section to the main body section; and the apparatus further comprising at least one separate, alternate replacement removable section the same as the first except in having a different size or shape balloon opening formed therein to enable alternate sized balloons to be used, and differently sized or shaped objects to be placed in balloons.

19. The apparatus of claim 18 wherein the projecting and exposed walls of the balloon opening of each removable section have outwardly flared outer ends to assist in retaining the balloon mouth about such walls as the balloon is inflated.

20. The apparatus of claim 18 wherein the enclosure includes a transparent portion to enable a user to see inside the enclosure when it is pressurized with an inflation gas.

21. The apparatus of claim 18 wherein, the projecting and exposed walls of the balloon opening of each removable section have outwardly flared outer ends to assist in retaining the balloon mouth about such walls as the balloon is inflated; and the walled enclosure includes a transparent portion to enable a user to see inside the enclosure when it is pressurized with an inflation gas.

22. The apparatus of claim 14 further comprising:

access sealing means extending from the access opening for, (a) fluid sealing the enclosure about the access opening when a balloon is received about the balloon opening and the enclosure filled with an inflation gas and sufficiently pressurized to inflate the balloon, and (b) enabling extension of a user's arm and hand through the access opening into the pressurized enclosure while maintaining inflation of the balloon, such that the user can handle the object to be placed in the balloon which is received within the enclosure and pass such object between the balloon opening walls and into the inflated balloon.

23. An inflated balloon having an object therein produced using the apparatus of claim 14.

24. A method of placing an object in a balloon, the balloon having a balloon mouth, the method comprising:

placing an object to be placed in a balloon into an enclosure;

sealingly securing the mouth of a balloon relative to one opening of the enclosure;

inserting a user's arm and hand through a second enclosure opening and positionally into the enclosures, the user's hand and at least a portion of the user's arm being fluid sealed relative to the enclosure;

filling the enclosure with an inflation gas to a pressure sufficient to expand and fill the balloon;

grasping the object with the user's hand and inserting the object into the inflated balloon; and removing the inflated balloon from the one opening and sealing the inflated balloon mouth to prevent significant escape of inflation gas from the balloon.

25. A balloon having an object received therein produced using the method of claim 24.

26. A method of placing an object in a balloon, the balloon having a balloon mouth, the method comprising:

placing an object to be placed in a balloon into an enclosure;

sealingly securing the mouth of a balloon relative to an opening of the enclosure;

filling the enclosure with an inflation gas to a pressure sufficient to expand and fill the balloon;

orienting the enclosure to position the enclosure opening at the bottom of the enclosure;

passing the object by means of gravity through the enclosure opening and into the inflated balloon; and removing the inflated balloon from the one opening and sealing the inflated balloon mouth to prevent significant escape of inflation gas from the balloon.

27. A balloon having an object received therein produced using the method of claim 26.

* * * * *